US005122080A

United States Patent [19]

Hatagishi et al.

[11] Patent Number: 5,122,080

[45] Date of Patent: Jun. 16, 1992

[54] ELECTRICAL CONNECTOR

[75] Inventors: Yuji Hatagishi; Toshifumi Matsuura, both of Shizuoka, Japan

[73] Assignee: Yazaki Corporation, Tokyo, Japan

[21] Appl. No.: 691,885

[22] Filed: Apr. 26, 1991

[30] Foreign Application Priority Data

May 16, 1990 [JP] Japan ..... 2-124209

[51] Int. Cl.[5] ..... H01R 13/40

[52] U.S. Cl. ..... 439/595; 439/598; 439/752

[58] Field of Search ..... 439/595, 598, 599, 752

[56] References Cited

U.S. PATENT DOCUMENTS

| | | | |
|---|---|---|---|
| 3,501,736 | 3/1970 | Norris | 339/91 |
| 4,867,712 | 8/1988 | Kato | 439/752 |
| 4,946,398 | 8/1990 | Takenouchi et al. | 439/595 |
| 4,946,399 | 8/1990 | Kawashima | 439/595 |
| 4,959,023 | 9/1990 | Watanabe et al. | 439/595 |

FOREIGN PATENT DOCUMENTS

| | | |
|---|---|---|
| 2200097 | 8/1988 | United Kingdom . |
| 2211033 | 10/1988 | United Kingdom . |

*Primary Examiner*—Paula A. Bradley

*Attorney, Agent, or Firm*—Sughrue, Mion, Zinn, Macpeak & Seas

[57] ABSTRACT

A connector for receiving terminals, in which a spacer is provided so as to be insertable slidably into a connector housing along slide rails. The spacer has a provisional locking position and a complete locking position, and includes withdrawal-prevention abutment portions and flexible retaining pieces, wherein the flexible retaining pieces are engaged with the terminals in their provisional locking positions, and the withdrawal-prevention abutment portions are engaged with the terminals in their complete locking positions. As to the spacer itself, a provisional locking pawl is provided at a distal end of a bottom portion of a branch plate which constitutes part of the spacer. Complete locking pawls are provided on upper and bottom portions of a base plate which constitutes another part of the spacer.

4 Claims, 5 Drawing Sheets

ELECTRICAL CONNECTOR

BACKGROUND OF THE INVENTION

The present invention relates to a connector, and in particular to an electrical connector of the type in which a terminal received in a housing body is retained by insertion of a spacer having a withdrawal-prevention abutment portion.

FIG. 7 is an exploded perspective view of a conventional connector 31 disclosed in Japanese Laid-Open (Kokai) Patent Application No. 54678/89, and FIG. 8 is a vertical cross-sectional view of the connector in its assembled condition. A similar construction may be found in commonly-assigned U.S. Pat. No. 4,867,712.

Referring to these Figures, communication holes 35 communicated with terminal receiving chambers 34 are formed through an upper wall 33 of a housing body 32 made of a synthetic resin. A spacer 38 of a synthetic resin having withdrawal prevention projections 37 for a female terminal 36 is inserted into the communication holes 35. Flexible retaining pieces 39, provided within the housing body 32, are disposed in respective terminal receiving chambers 34. When a female terminal 36 is inserted into one of the terminal receiving chambers 34, the flexible retaining piece 39 is engaged in a notch 40 in the female terminal 36, so as to retain the female terminal 36.

Mold release holes 42 are formed in an end wall 41 of the housing body 32 and serve as insertion holes for inserting a jig bar (not shown) so as to release the flexible retaining pieces 39 from the mold to allow the housing body to be removed from the mold. Mating terminal insertion holes 43 also are formed in the end wall 41, each of the mold release holes 42 being continuous with a respective one of the mating terminal insertion holes 43. Provisional retaining pawls 44 and complete retaining pawls 45 which act on the housing body 32 are formed on the spacer 38. When the spacer 38 is pushed from the position shown in FIG. 8, the withdrawal prevention projection 37 is engaged with a projected portion 46 of-the female terminal 36, thereby preventing rearward withdrawal of the female terminal 36.

However, in the above terminal retaining connector 31, since the mold release hole 42 for the flexible retaining piece 39 and the mating terminal insertion hole 43 are continuous with each other, a distal end 47 of the female terminal 36 is exposed to an opening 48, as shown in FIG. 9. When a mating male terminal 49 is to be inserted, the distal ends 47 and 50 of the terminals 36 and 49 often collide with each other. As a result, insertion is not carried out smoothly, and in some cases the terminals 36 and 49 are damaged.

SUMMARY OF THE INVENTION

In view of the above problems, it is an object of this invention to provide a connector of the type in which exposure of a terminal resulting from the provision of a mold release hole for a flexible retaining piece is eliminated, and a terminal can be smoothly inserted, thereby preventing damage to the terminals.

The above object has been achieved by a connector wherein a communication hole for terminal receiving chambers is provided in a housing body; and a spacer having withdrawal-prevention abutment portions for terminals disposed in the terminal receiving chambers is inserted into said communication hole. The connector is characterized particularly in that the communication hole extends from a side wall of the housing body in a direction perpendicular to the terminal receiving chambers. Further, flexible retaining pieces for the terminals and the withdrawal-prevention abutment portions are formed on the spacer sequentially in the direction of insertion of the spacer. The flexible retaining piece is engaged with the terminal when the spacer is in a provisionally retained condition, and the withdrawal-prevention abutment portion is engaged with said terminal when the spacer is in a completely retained condition.

Advantageously, terminal insertion holes for inserting mating terminals of the terminals thereinto and retention release holes for the flexible retaining pieces are provided in an end wall of the housing body separately from each other.

Since the flexible retaining pieces are provided on the spacer, there is no need to provide mold release holes for flexible retaining pieces in the housing body as is the case with the conventional connectors. Therefore, the mating terminal insertion holes and the retention release holes for the flexible retaining pieces can be provided in the end wall of the housing body separately from each other.

DETAILED DESCRIPTION OF THE PREFERRED EMBODIMENT

Figure 1:
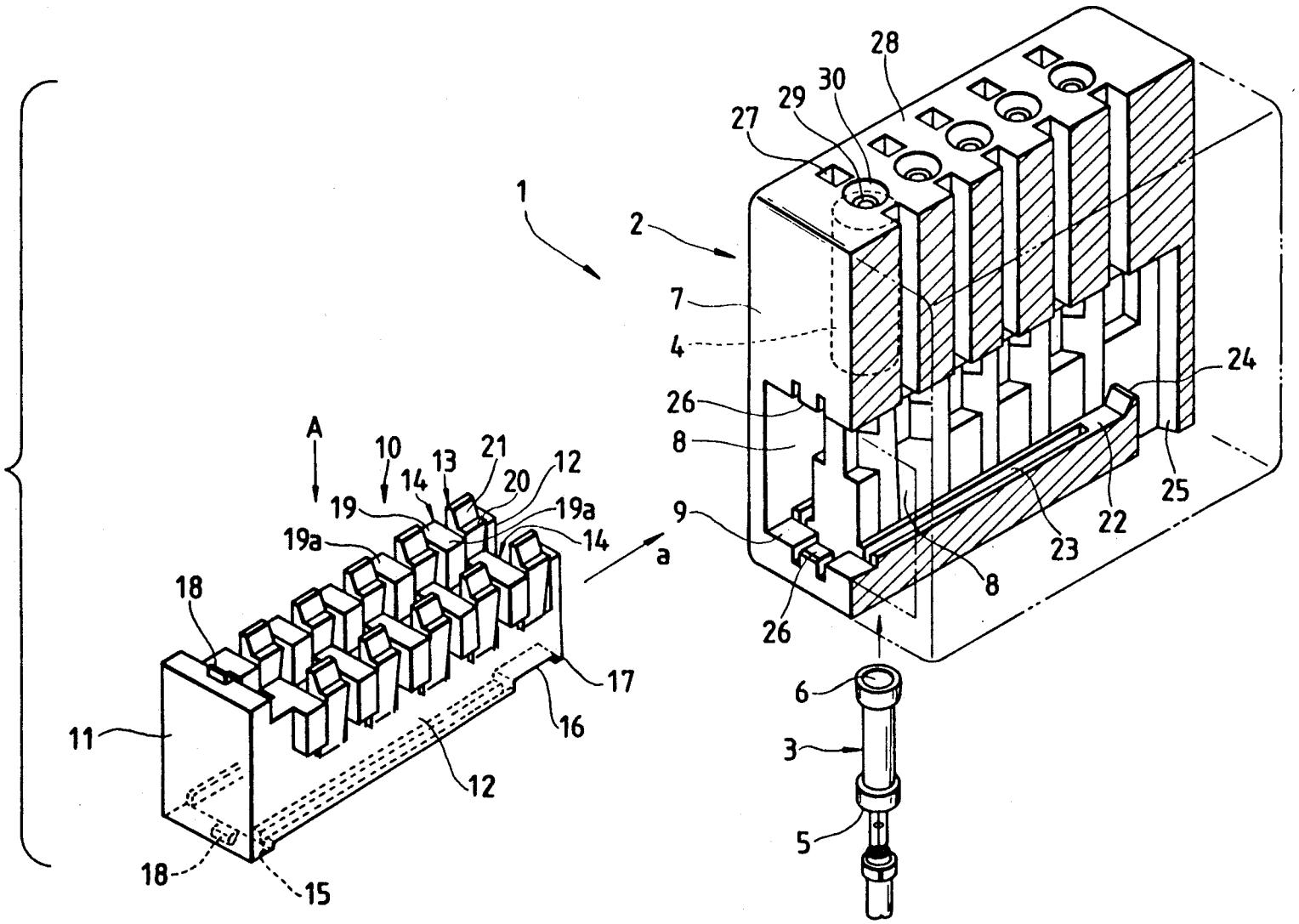
FIG. 1 is an exploded perspective view of a preferred embodiment of the present invention.

In FIG. 1, a plurality of terminal receiving chambers 4 for receiving respective tubular female terminals 3 are provided in juxtaposed relation within a housing body 2 made of a synthetic resin. In the drawings, although the terminal receiving chambers 4 are shown as being arranged in one row, these chambers actually are arranged in a plurality of rows. The female terminal 3 has an annular proximal end face 5. A pin-like male terminal (not shown) is inserted into the female terminal from an opening 6 provided at the distal end of the female terminal. A plurality of juxtaposed communication holes 8 are formed in the housing body 2, and extend from a side wall 7 of the housing body 2 in a direction perpendicular to the terminal receiving chambers 4. A spacer 10 made of a synthetic resin is inserted into the communication holes 8 from an opening 9 in the side wall 7.

Figure 2:
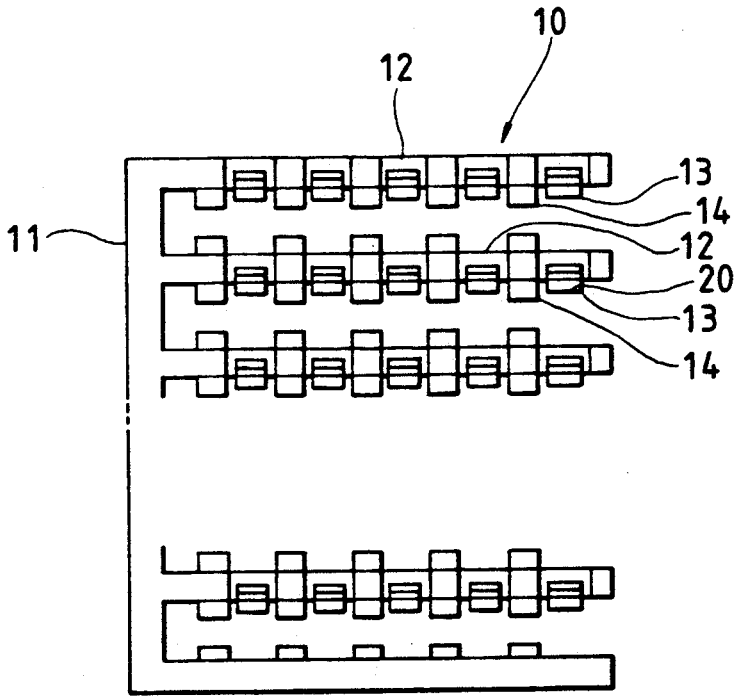
FIG. 2 is a view (i.e., plan view of a spacer) as seen in a direction of arrow A of FIG. 1.

As shown in FIG. 2, which is a view as seen from an arrow A in FIG. 1, a plurality of juxtaposed branch plates 12, formed on a base plate portion 11, are disposed perpendicular thereto. Flexible retaining pieces 13 and rigid withdrawal-prevention abutment portions 14 of a square pillar shape (both of which correspond in number to the terminal receiving chambers 4) are formed alternately on each of the branch plates 12 from the distal end to the proximal end of the branch plate 12. A slide rail 15 (FIG. 1) is provided at a bottom portion of the branch plate 12. A notch 16 is provided at the distal end portion of the bottom portion of the branch plate 12 to form a provisional retaining pawl 17 at the distal end of the bottom portion. Complete retaining pawls 18 are formed on the upper and lower ends of the base plate portion 11, respectively.

The flexible retaining piece 13 has a retaining surface 20 flush with an upper surface 19 of the withdrawal-prevention abutment portion 14, and a tapered surface 21 extending upwardly from the retaining surface 20 in an inclined manner. An edge 19*a* of the upper surface 19 of the withdrawal-prevention abutment portion 14 is adapted to be abutted against the proximal end face 5 of the tubular female terminal 3. The two opposed withdrawal-prevention abutment portions 14, 14 are abutted against one female terminal 3 at the same time.

A guide groove 23 for the slide rail 15 of the spacer 10 is provided at a peripheral wall 22 of the communication hole 8. An engaging projection 24 for the provisional retaining pawl 17, and a space 25 for bringing the notch 16 of the spacer 10 into sliding contact with the engaging projection 24 are provided forwardly of the distal end of the guide groove 23. Engaging projections 26 for the complete retaining pawls 18 are formed on the edge of the opening 9 in the side wall 7. Retention release holes 27 for the insertion of a jig bar (not shown) thereinto are provided adjacent to the respective terminal receiving chambers 4, and are disposed in register with respective tapered surfaces 21 of the flexible retaining pieces 13. The retention release holes 27 and mating terminal insertion holes 29 formed in an end wall 28 are separate from each other, the mating terminal insertion holes 29 communicating with the respective terminal receiving chambers 4. The mating terminal receiving hole 29 is chamfered, as at 30, so that the pin-like male terminal (not shown) can be easily inserted thereinto.

Figure 3:
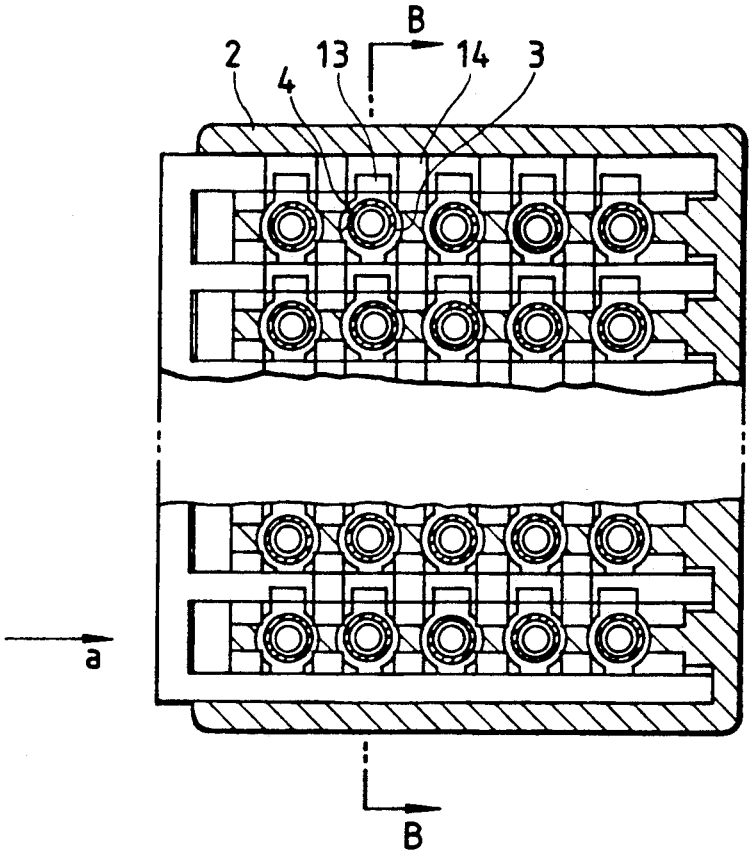
FIG. 3 is a horizontal cross-sectional view showing the spacer in a provisionally retained condition.
Figure 4:
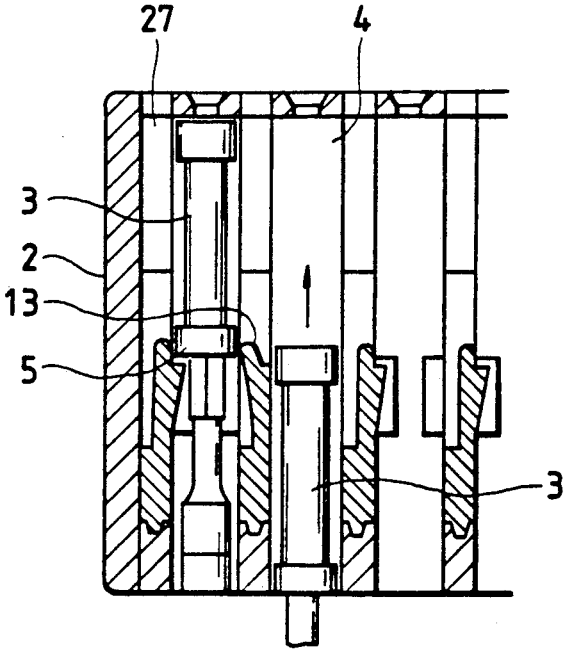
FIG. 4 is a cross-sectional view taken along the line B—B in FIG. 3.

FIG. 3 is a horizontal cross-sectional view showing that the spacer 10, inserted in the housing body 2, is held in a provisionally retained condition in which the provisional retaining pawls 17 are engaged with the respective engaging projections 24. FIG. 4 is a cross-sectional view taken along the line B—B in FIG. 3.

More specifically, the flexible retaining piece 13 is disposed in the terminal receiving chamber 4. When the female terminal 3 is inserted into the terminal receiving chamber 4, the flexible retaining piece 13 is flexed outwardly to allow entry of the female terminal 3, and then is restored to be engaged with the proximal end face 5 of the female terminal 3. When the female terminal 3 is to be withdrawn, the jig bar (not shown) is inserted into the retention release hole 27 to deform the flexible retaining piece 13 outwardly.

Figure 5:
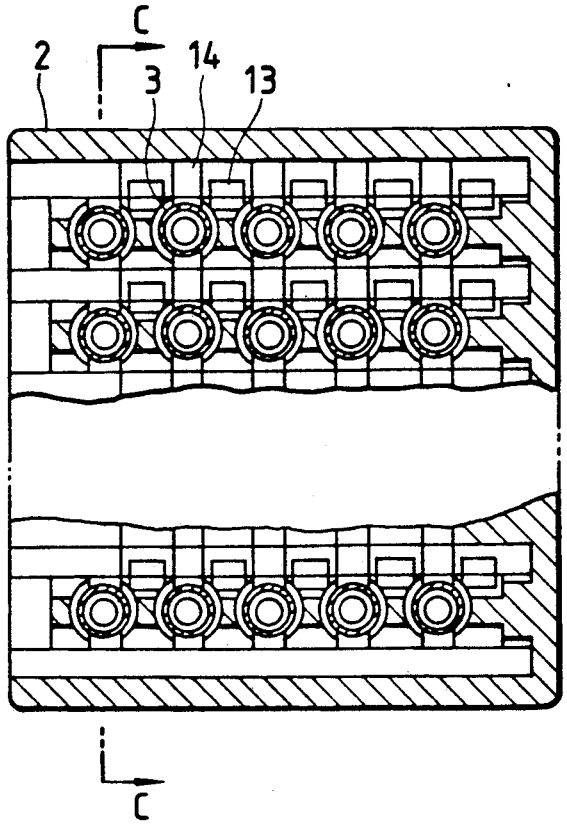
FIG. 5 is a horizontal cross-sectional view showing the spacer in a completely retained condition.
Figure 6:
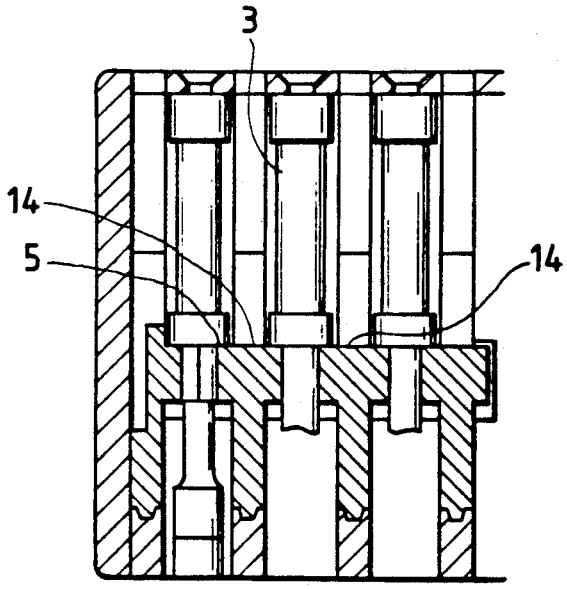
FIG. 6 is a cross-sectional view taken along the line C—C of FIG. 5.
Figure 8:
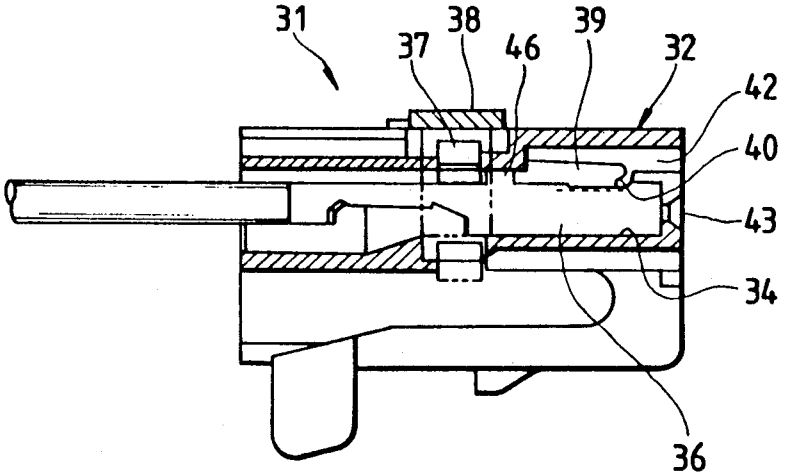
FIG. 8 is a vertical cross-sectional view of the connector of FIG. 7.
Figure 9:
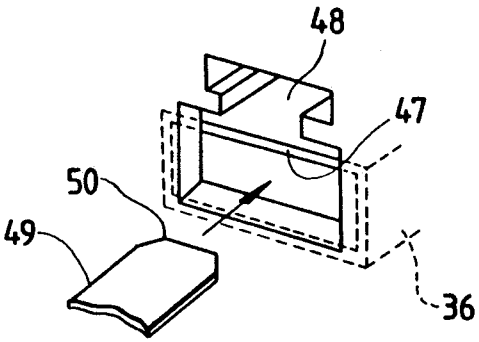
FIG. 9 is a perspective view showing deficiencies of the connector of FIG. 7.
Figure 7:
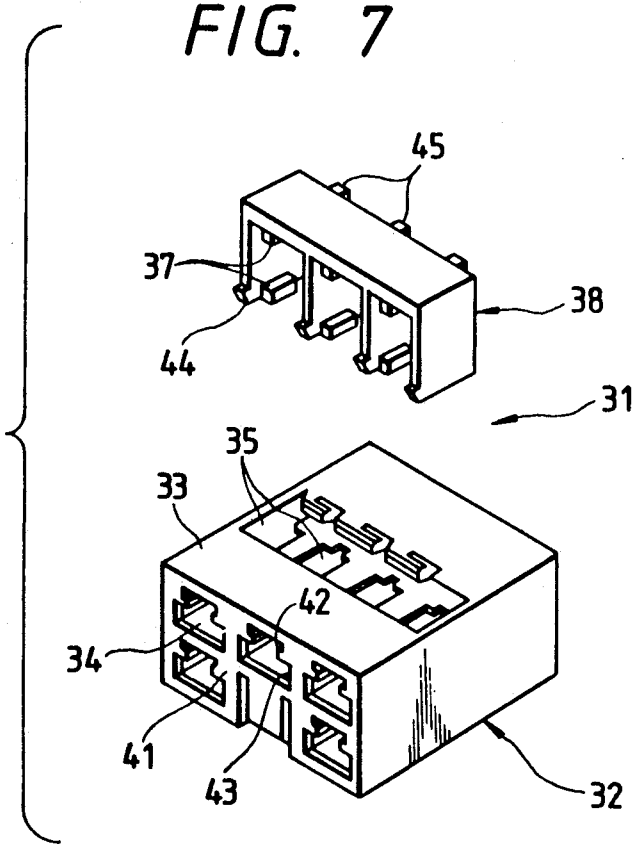
FIG. 7 is an exploded perspective view of a conventional connector.

Then, the spacer 10 is pushed further in the direction of an arrow (FIG. 3), the flexible retaining piece 13 is disengaged from the female terminal 3, and the rigid withdrawal-prevention abutment portions 14 are engaged with the proximal end face 5 of the female terminal 3, as shown in FIGS. 5 and 6. In this condition, the female terminal 3 is retained firmly by the opposed withdrawal-prevention abutment portions 14, 14 from opposite sides. The complete retaining pawls 18 (see FIG. 1) are engaged with the respective engaging projections 26 to achieve the complete retaining condition. In this condition, since only the rigid withdrawal-prevention abutment portions 14 are engaged with the female terminal 3, rearward withdrawal of the female terminal 3 can be prevented positively. If the female terminal 3 is in an incompletely inserted condition when the spacer 10 is to be pushed to achieve the complete retaining condition, the withdrawal-prevention abutment portions 14 interfere with the female terminal 3, so that the spacer 10 cannot be pushed. Therefore, such incomplete insertion of the female terminal 3 can be prevented.

As described above, according to the present invention, the terminal can be engaged easily with the flexible retaining piece when the spacer is in the provisionally retained condition. In the completely retained condition, the flexible retaining terminal is disengaged from the terminal, so that only the rigid withdrawal-prevention abutment portions are brought into engagement with the terminal. Therefore, the terminal can be retained firmly, so as positively to prevent rearward withdrawal of the terminal. Further, if the terminal is in an incompletely inserted condition when the spacer is to be pushed to achieve the complete retaining condition, the withdrawal-prevention abutment portions interfere with the terminal, so that the spacer cannot be pushed. Therefore, such incomplete insertion of the terminal can be prevented.

Still further, since the flexible retaining pieces are formed on the spacer, there is no need to provide mold release holes for flexible retaining pieces, as is necessary with conventional connectors. Therefore, the housing body can be molded easily from a resin, and the mating terminal insertion holes and the retention release holes for the flexible retaining pieces can be provided in the end wall of the housing body separately from each other. As a result, the terminal will not be exposed through the mating terminal insertion hole. Therefore, when the mating terminal is to be inserted, the terminals will not collide with each other, and the mating terminal can be inserted smoothly, thereby preventing damage to the terminals.

While the invention has been described in detail above with reference to a preferred embodiment, various modifications within the scope and spirit of the invention will be apparent to people of working skill in this technological field. Thus, the invention should be considered as limited only by the scope of the appended claims.

We claim:

1. A connector comprising:

a housing body including a side wall, having a communication hole disposed therein, and a plurality of terminal receiving chambers, said communication hole extending in a direction perpendicular to said terminal receiving chambers; and a spacer, inserted into said communication hole in said perpendicular direction and having a provisionally retained condition and a completely retained condition within said communication hole, said spacer including withdrawal-preventing abutment portions and flexible retaining pieces formed sequentially thereon in said perpendicular direction;

wherein each of said flexible retaining pieces is engaged with a respective one of said terminals when said spacer is in said provisionally retained condition, and wherein each of said withdrawal-prevention abutment portions is engaged with a respective one of said terminals when said spacer is in said completely retained condition.

2. A connector according to claim 1, wherein said housing body further includes an end wall having terminal insertion holes formed therein for inserting mating terminals of said terminals thereinto, said end wall further having separate retention release holes for said flexible retaining pieces.

3. A connector according to claim 1, wherein said spacer includes a base plate portion and a pair of branch plates extending therefrom, said branch plates having respective slide rails provided at bottom portions thereof, said spacer further including a provisional retaining pawl at a distal end of each of said bottom portions, and a pair of complete retaining pawls, formed on upper and lower ends of said base plate portion.

4. A connector according to claim 1, further including a retaining surface on each of said flexible retaining pieces, said retaining surface having a tapered surface extending upwardly therefrom.

* * * * *